US006169522B1

(12) United States Patent
Ma et al.

(10) Patent No.: US 6,169,522 B1
(45) Date of Patent: Jan. 2, 2001

(54) COMBINED MECHANICAL SCANNING AND DIGITAL BEAMFORMING ANTENNA

(75) Inventors: Stephen Chihhung Ma, Mesa; Keith Warble, Chandler; A. David Munger; Richard Scott Torkington, both of Mesa; David Warren Corman, Gilbert; Deborah Dendy, Tempe, all of AZ (US)

(73) Assignee: Motorola, Inc., Schaumburg, IL (US)

( * ) Notice: Under 35 U.S.C. 154(b), the term of this patent shall be extended for 0 days.

(21) Appl. No.: 09/389,637

(22) Filed: Sep. 3, 1999

(51) Int. Cl.[7] ..... H01Q 21/00
(52) U.S. Cl. ..... 343/853; 343/757; 342/357
(58) Field of Search ..... 343/754, 755, 343/753, 757, 840, 853; 342/352, 354, 368, 371, 357

(56) References Cited

U.S. PATENT DOCUMENTS 3,761,935 * 9/1973 Silbiger et al. ..... 343/754
3,775,769 * 11/1973 Heeren et al. ..... 343/754
3,916,415 * 10/1975 Howery ..... 343/754
4,034,374 7/1977 Kruger ..... 343/16 R
4,996,532 2/1991 Kirimoto et al. ..... 342/81
5,023,634 6/1991 Nishioka et al. ..... 342/368
5,686,923 * 11/1997 Schaller ..... 343/755
5,936,592 * 8/1999 Ramanujam et al. ..... 343/853

* cited by examiner

*Primary Examiner*—Tan Ho
(74) *Attorney, Agent, or Firm*—Frank J. Bogacz; Jeff D. Limon

(57) ABSTRACT

A mechanical scanning and digital beamforming antenna (20, FIG. 2) uses a receive and transmit digital beamforming network (FIG. 3, 410, 320) to provide communications beam scanning in a first plane. In a second plane, a reflective surface (FIG. 2, 240) is used to focus and scan the communications beam. Through proper orientation of the reflective surface (240), a communications satellite (FIG. 1, 10) can be tracked by way of electronic scanning by way of the transmit or receive digital beamforming network (FIG. 3, 320, 410). Thus, the complexity of the digital beamforming network is reduced as is the wear on the mechanical components of the antenna. The mechanical scanning and digital beamforming antenna (20, FIG. 20) makes use of a second digital beamforming network (FIG. 3, 415, 325) and reflective surface (FIG. 3, 250) to ensure that two communications satellites can be simultaneously tracked.

5 Claims, 5 Drawing Sheets

20

COMBINED MECHANICAL SCANNING AND DIGITAL BEAMFORMING ANTENNA

FIELD OF THE INVENTION

The invention relates to antennas and, more particularly, to antennas which generate and steer communication beams toward moving communications nodes.

BACKGROUND OF THE INVENTION

In a high bandwidth communications system, where communications nodes are in motion relative to earth-based subscriber units, a subscriber unit must maintain a link with the moving communications node using a narrow communications beam. A narrow communications beam allows the earth-based subscriber unit to transmit information to, and receive information from, the moving communications node using high data rates. Typically, as a receive or transmit communications beam becomes progressively more narrow, an increasingly higher data rate can be used to communicate information between the communications node and the earth-based subscriber unit due to the increased concentration of energy in the communications beam.

Previous earth-based systems used for acquiring and tracking moving communications nodes, such as satellites placed in a low earth orbit, involve the use of mechanically steered reflector antennas. However, when the moving communications node is a low earth orbiting satellite, the satellite may travel from one horizon to another in only a few minutes. Consequently, the low earth orbiting satellite may be in view of the subscriber unit for only a short period of time while moving rapidly overhead. Therefore, the pointing direction of the mechanically steered reflector antenna requires virtually constant correction in order to maintain the communications link between the satellite and the earth-based subscriber unit, thus causing the mechanical components of the reflector antenna to wear out and require periodic replacement. This periodic replacement increases the cost which an earth-based subscriber must pay in order to receive and transmit high bandwidth information to and from a moving satellite communications node.

Other disadvantages of mechanically steered reflector antennas include a large physical size and an inability to steer the antenna quickly, as is required when communications with one satellite must be suspended at the horizon and another satellite must be acquired at an opposite horizon.

Other techniques for maintaining a link with a moving communications node involve the use of two-dimensional electronically scanned arrays which make use of a digital beamforming network. In a two-dimensional antenna array which uses a digital beamforming network, each transmit antenna element incorporates an individual power amplifier. Additionally, each receive element incorporates an individual low noise amplifier. The need for individual amplification in both the receive and transmit antenna elements, as well as the need to perform a large number of digital operations in the beamforming network, and the need for a large number of interconnections between the beamforming network and the array of antenna elements necessitates substantial complexity in the required electronics. This additional complexity increases the cost of the satellite communications system.

Therefore, what is highly desirable, is a subscriber antenna system with a reduced number of constituent moving parts which provides beam steering towards a moving communications node. What is also highly desirable, is a subscriber antenna system with a reduced number of transmitting and receiving antenna elements in order to reduce the complexity of the beamforming network. These features can lower the cost of the earth-based subscriber equipment and allow the benefits of the satellite communications system to be accessible to a greater number of earth-based subscribers.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

DESCRIPTION OF THE PREFERRED EMBODIMENTS

A combined mechanical scanning and digital beamforming antenna provides the capability for subscribers to receive and transmit high bandwidth information to and from a moving communications node using low cost and highly reliable equipment. The antenna combines a reduced number of mechanical components with a reduced-complexity digital beamforming network. Additionally, the unique design which incorporates two similar antennas integrated into the same enclosure enables a smooth hand over from communications with one moving node to a second moving node. Therefore, users can maintain contact with the satellite communications system without interruption of service.

Figure 1:
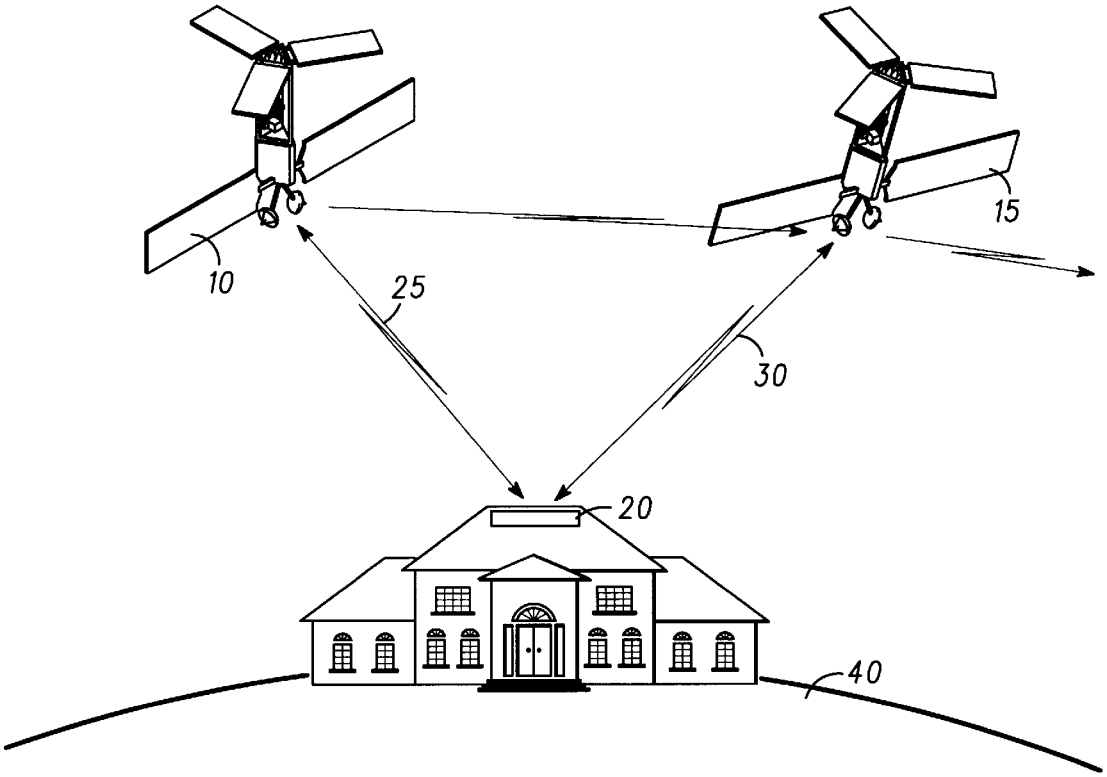
FIG. 1 shows a roof-top mounted subscriber unit (20) which is in communications with two moving communications nodes in accordance with a preferred embodiment of the invention.

FIG. 1 shows a rooftop mounted subscriber unit which is in communications with two moving communications nodes in accordance with a preferred embodiment of the invention. In FIG. 1, moving communications nodes 10 and 15 are represented as low earth orbit satellites. Moving communications nodes 10 and 15 are in communications with mechanical scanning and digital beamforming antenna 20 through communications beams 25 and 30. Desirably, mechanical scanning and digital beamforming antenna 20 is functionally integrated into a terrestrial-based subscriber unit which provides a broadband voice and data communications capability.

Although moving communications nodes 10 and 15 are shown as discrete satellites, in a preferred embodiment these satellites are representative of a global communications network with an interface to a terrestrial voice and data telecommunications infrastructure. Additionally, moving communications nodes 10 and 15 can communicate with each other as well as other similar satellites through intersatellite crosslinks. Thus, moving communications nodes 10 and 15 provide voice and data capabilities which enable mechanical scanning and digital beamforming antenna 20 to transmit data to and receive data from the terrestrial voice and data infrastructure through moving communications nodes 10 and 15.

By way of example, and not by way of limitation, moving communications node 15 is moving away from mechanical scanning and digital beamforming antenna 20 and will soon pass beyond the horizon. Meanwhile, moving communications node 10 is also in view of mechanical scanning and digital beamforming antenna 20 and will soon be directly overhead. In a preferred embodiment, mechanical scanning and digital beamforming antenna 20 maintains a link with both moving communications nodes 10 and 15 as these nodes move relative to surface of the earth 40.

Each of moving communications nodes 10 and 15 may come into view from a different point on the horizon, as well as move out of view at a different point on the opposite horizon. Thus, moving communications node 10 may come into view of mechanical scanning and digital beamforming antenna 20 from a due North direction while moving communications node 15 comes into view from a North by Northeast direction. Further, moving communications node 10 may reach the horizon at a location of due South, while moving communications node 15 may reach the horizon at a location of South by Southwest.

In a preferred embodiment, mechanical scanning and digital beamforming antenna 20 makes use of a "make before break" technique in which the communications link with moving communications node 15 is maintained until a link with moving communications node 10 can be established. Thus, only after a link with moving communications node 10 has been established is a link with moving communications node 15 discontinued. Consequently mechanical scanning and digital beamforming antenna 20 includes two independently steerable antennas in order to realize the "make before break" capability.

Figure 2:
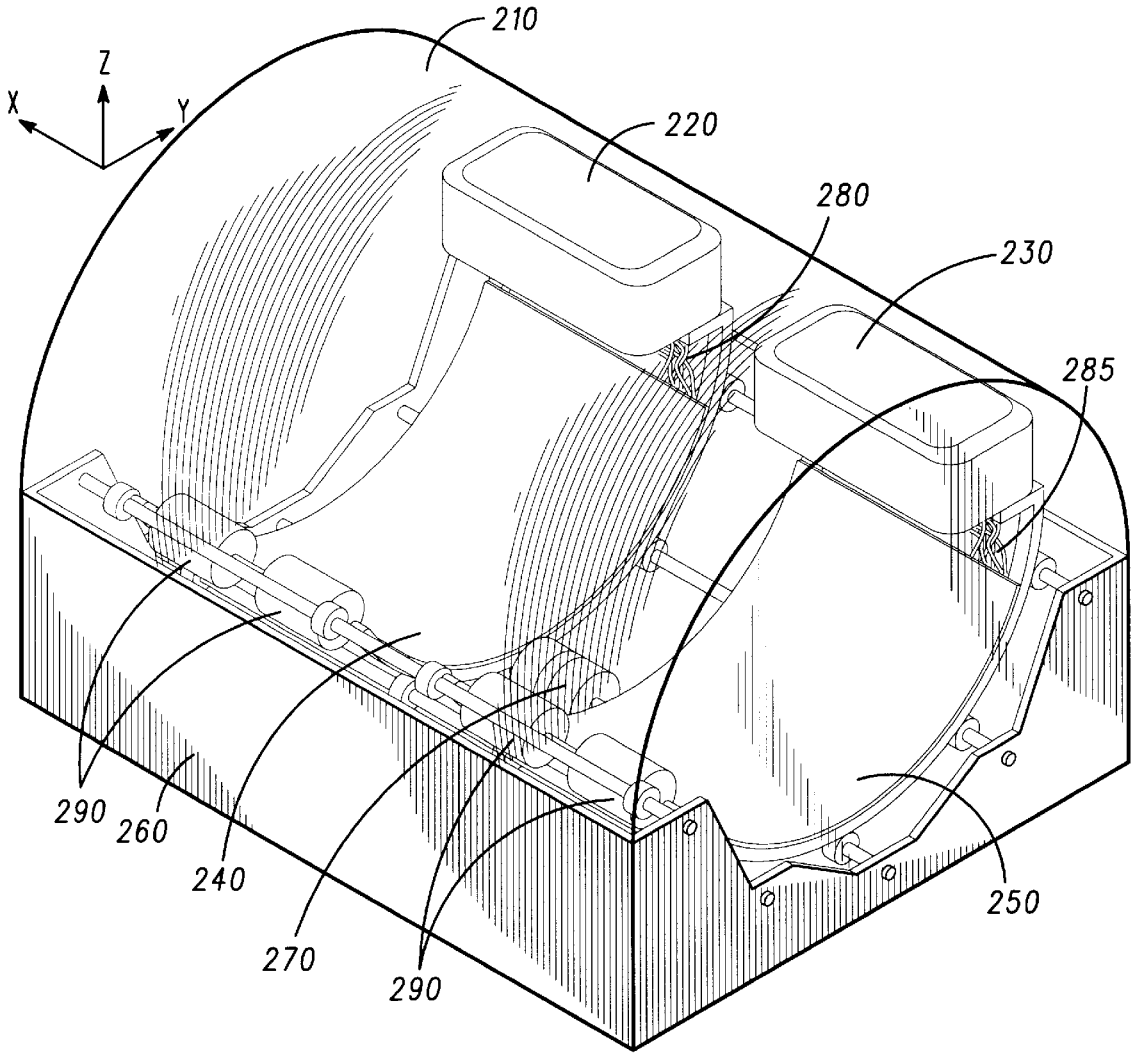
FIG. 2 shows a mechanical scanning and digital beamforming antenna in accordance with a preferred embodiment of the invention.

FIG. 2 illustrates a mechanical scanning and digital beamforming antenna in accordance with a preferred embodiment of the invention. By way of example, and not by way of limitation, linear arrays 220 and 230 are comprised of individual antenna radiating elements which enable a communications beam to be focused in the X-Z plane. The individual antenna elements which comprise linear arrays 220 and 230 can be any type of radiating element. A suitable radiating element includes (but is not limited to) a dipole, monopole above an appropriate ground plane, patch antenna, microstrip notch, or horn antenna.

Radio frequency signals to and from linear arrays 220 and 230 are conveyed to appropriate external equipment, such as up converters and down converters through flexible wiring harnesses 280 and 285. In an alternate embodiment, some or all of the external equipment may be integrated with linear arrays 220 and 230 and moved with the reflector antenna surface and the linear array, thus reducing the number of moving interconnections. Suitable up conversion and down conversion equipment, as well as other external equipment including digital beamforming networks are discussed in reference to FIG. 3, herein.

The communications beams focused in the X-Z plane by linear arrays 220 and 230 impinge upon reflective surfaces 240 and 250, respectively. In a preferred embodiment, these reflective surfaces possess a cylindrical, parabolic, or other desired curvature in the Y-Z plane. Thus, through the combination of linear arrays 220 and 230, and reflective surfaces 240 and 250, two independent communications beams can be focused in both the X-Z and the Y-Z planes. Further, the communications beam can be scanned in the Y-Z plane through rotation of reflective surfaces 240 and 250 and associated linear arrays 220 and 230 by way of motor drive unit 270.

Desirably, the X-Z and Y-Z planes, as shown in FIG. 2, are orthogonal. However, the present invention is not limited to the use of a coordinate system where the X-Z and Y-Z planes are at strictly right angles to each other. Additionally, nothing prevents the adaptation of the antenna FIG. 2 to operate in a non-Cartesian coordinate system such as cylindrical or spherical coordinates. Further, a non-Cartesian coordinate system can be used to express the X-Z, Y-Z, and X-Y planes as depicted in FIG. 2 through appropriate coordinate transformations.

Radome 210 protects the functional elements of mechanical scanning and digital beamforming antenna 20 from the effects of exposure to an outside environment. Radome 210 can incorporate anti-icing features provided these features do not interfere with radio frequency signal propagation. In the event that any anti-icing features incorporated into radome 210 interferes with RF signal propagation, mechanical scanning and digital beamforming antenna 20 preferably incorporates the necessary compensation features in order to mitigate the effects of this interference. Radome 210 is desirably placed in intimate contact with housing 260 in order to provide an airtight environmental seal which reduces the possibility that humidity, dust, or other environmental effects can degrade the performance of the antenna.

Mechanical scanning and digital beamforming antenna 20 also includes counterbalances 290. Counterbalances 290 serve to provide a mass which is substantially equal to the mass of linear arrays 220 and 230. The use of counterbalances 290 serves to reduce the mechanical strain on motor drive unit 270.

Figure 3:
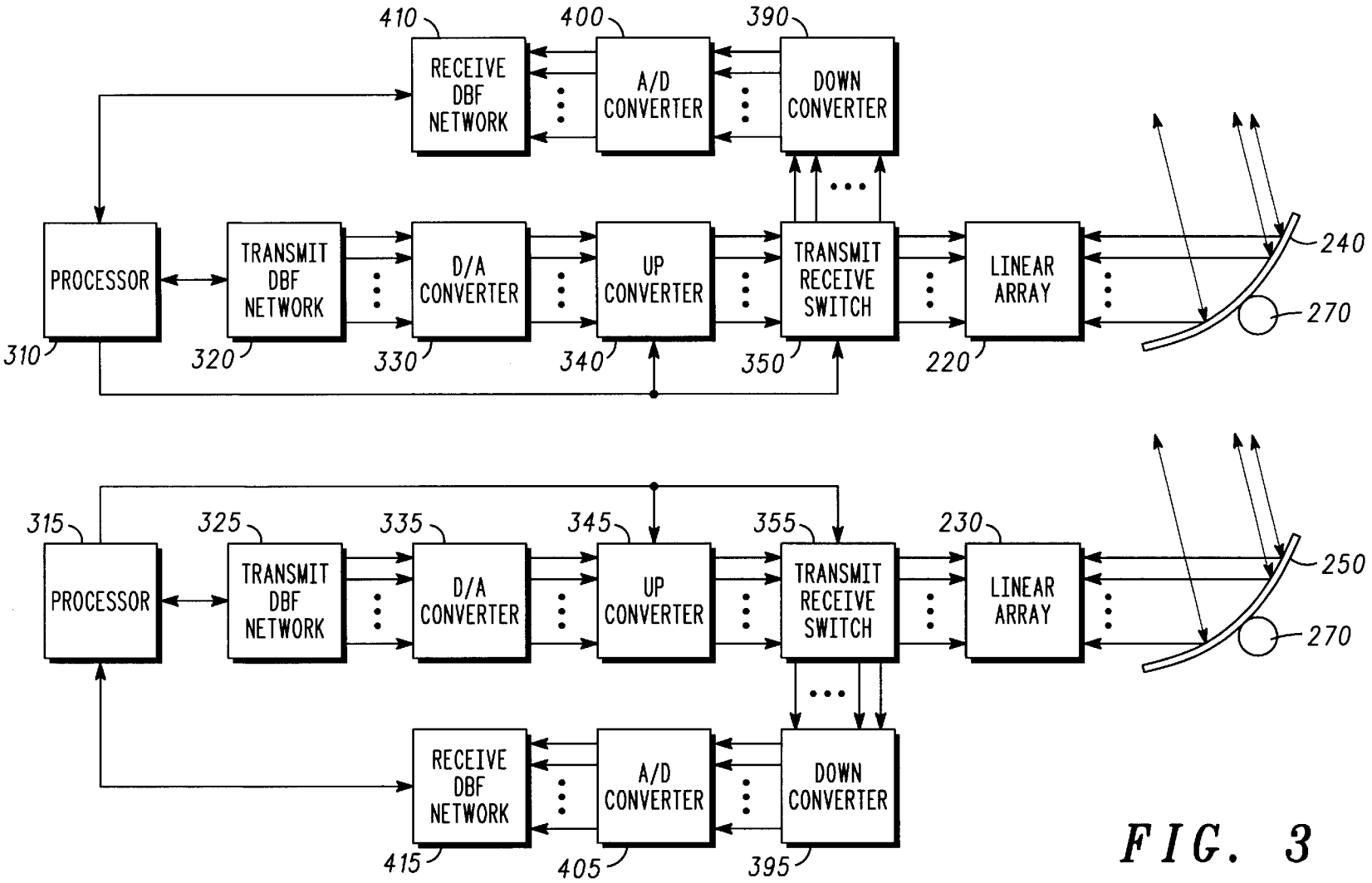
FIG. 3 is a block diagram of the functional elements used in conjunction with the mechanical scanning and digital beamforming antenna of FIG. 2 in accordance with a preferred embodiment of the invention.

FIG. 3 is a block diagram of the functional elements used in conjunction with the mechanical scanning and digital beamforming antenna (20) of FIG. 2 in accordance with a preferred embodiment of the invention. In FIG. 3, processor 310 controls the operation of transmit and receive digital beamforming networks 320 and 410. Additionally, processor 310 controls the frequency selections of up converter 340, and down converter 390. Further, processor 310 controls the transmit and receive state of mechanical scanning and digital beamforming antenna 20 through the control of transmit/receive switch 350.

In a preferred embodiment, transmit digital beamforming network 320 performs the necessary antenna element signal processing in order to generate the amplitude and phase of each of the radiating elements which comprise linear array 220. In a preferred embodiment, transmit digital beamforming network includes an output for each antenna radiating element which comprises linear array 220.

Transmit digital beamforming network 320 is coupled to digital to analog converter 330. Digital to analog converter 330 performs the conversion of the digitally formatted antenna element weights, which represent the relative amplitude and phase of each antenna element, to a base band analog signal format. The analog signals from digital to analog converter 330 are coupled to up converter 340 where the analog signals are converted to antenna excitation signals. The outputs of up converter 340 are conveyed to transmit receive switch 350, which desirably allows the converted signals to pass directly to linear array 220. The resultant communications beam generated by linear array 220 is then impressed upon reflective surface 240 and radiated to an external receiver such as moving communications node 10 or 15 of FIG. 1. As the external receiver moves in an X-Z or Y-Z plane, transmit digital beamforming network 320 modifies the antenna element weights of linear array 220 in order to steer the communications beam in the X-Z plane. Further, motor drive unit 270 controls the orientation of reflective surface 240 in order to steer the communications beam in the Y-Z plane.

When processor 310 determines that mechanical scanning and digital beamforming antenna 20 is to receive information from an external transmitter, processor 310 sets transmit/receive switch 350 to the receive position. In this position, signals received from an external transmitter and conveyed through linear array 220 are conveyed to down converter 390. In a preferred embodiment, down converter 390 converts the receive signals to a base band frequency and conveys these to analog to digital converter 400. Analog to digital converter 400 converts the base band signals to a digital format and outputs these to receive digital beamforming network 410. Receive digital beamforming network 410 then performs any necessary digital operations which remove the information from the incoming signal.

Alternatively, if transmit (up link) and receive (down link) frequencies are substantially different, transmit/receive switch 350 can be replaced by appropriate frequency multiplexers. Through the use of frequency multiplexing, the difference in frequency is exploited in order to couple the received signals from linear array 220 to the received signal path through down converter 390. Similarly, frequency multiplexing enables transmit signals from up converter 340 to be coupled to linear array 220.

In another alternate embodiment which makes use of differing transmit and receive frequencies, separate but interlaced radiating elements within linear array 220 are used for each frequency. In this embodiment, the function of transmit/receive switch 350 is not required since the transmit and receive radiating elements of linear array 220 are coupled to dedicated receive and transmit paths. Either of these alternative implementations allows for simultaneous transmit and receive operation In a preferred embodiment, the apparatus of FIG. 3 is substantially duplicated in order to provide the capability for mechanical scanning and digital beamforming of a second communications beam using linear array 230 and reflective surface 250 of FIG. 2. Thus, processor 315 performs largely identical tasks as processor 310. Additionally, transmit digital beamforming 325, digital to analog converter 335, up converter 345, transmit/receive switch 355, linear array 230, reflective surface 250, down converter 395, analog to digital converter 405, and receive digital beamforming network 415 perform substantially identical functions as their previously discussed counterparts. Motor drive 270 provides the drive mechanism for reflective surface 250, as well as reflective surface 240.

In the discussion of FIGS. 1, 2 and 3, it has been assumed that moving communications nodes 10 and 15 (of FIG. 1) originate from substantially the same location on the horizon. However, in the event that the antenna of FIGS. 2 and 3 is operated in conjunction with moving communications nodes which originate from varying horizon locations, the antenna may incorporate additional means to allow positioning of the mechanical axis of the antenna orthogonal to the trajectory of the moving communications node. This additional positioning means may be desirable since it allows the bulk of the tracking of the moving communications node to be performed by linear arrays 220 and 230 over a wider variety of trajectories of the moving communications nodes.

In an alternate embodiment, the antenna of FIGS. 2 and 3 can be used in conjunction with terrestrial communications nodes. In this embodiment, it may be desirable to reorient the antenna in order to enable linear arrays 220 and 230 to scan in the X-Y plane, as opposed to the X-Z plane as shown in FIG. 2. Additionally, transmit and receive digital beamforming networks 320, 325, 410, and 415 can each be used to generate multiple communications beams, thus providing a means of communicating with multiple terrestrial communications nodes located in the X-Y plane. The capability of digital beam forming networks 320, 325, 410, and 415 to form multiple communications beams is well known to those skilled in the art.

Figure 4:
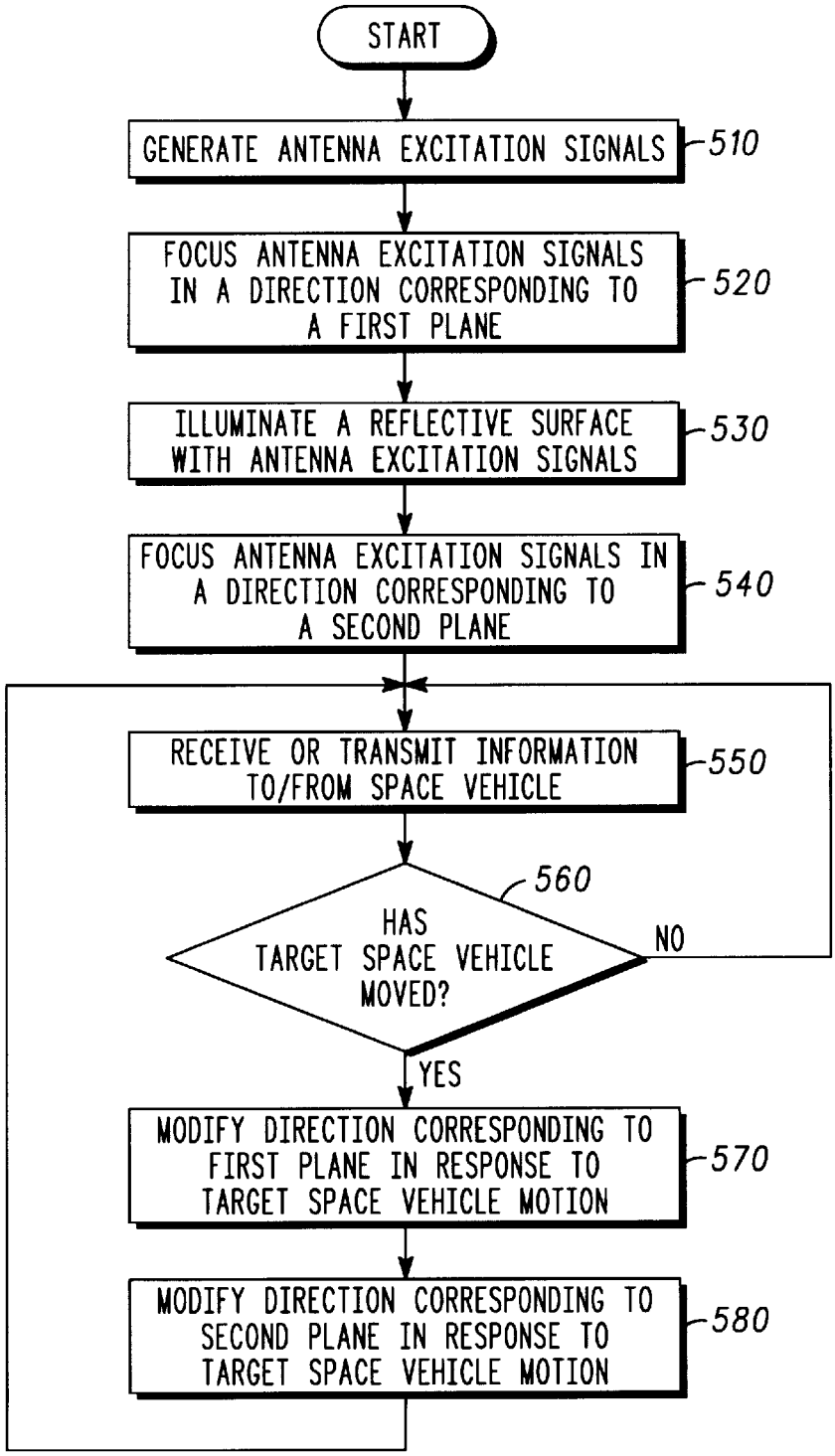
FIG. 4 is a flow chart of a method executed by a mechanical scanning and digital beamforming antenna in accordance with a preferred embodiment of the invention.

FIG. 4 is a flow chart of a method executed by a mechanical scanning and digital beamforming antenna in accordance with a preferred embodiment of the invention. The apparatus of FIG. 3 is suitable for performing the method. The method of FIG. 4 begins with step 510, wherein a suitable apparatus, such as up converters 340 or 345 of FIG. 3, generates antenna excitation signals. Preferably these antenna excitation signals operate at a carrier frequency and are used to convey information from a subscriber unit to a moving communications node. In step 520 the antenna excitation signals are focused in a direction corresponding to a first plane. In step 530, a reflective surface is illuminated with the antenna excitation signals from step 520. In step 540, the reflective surface focuses the antenna excitation signals in a direction corresponding to a second plane.

After the antenna excitation signals are focused in the directions corresponding to a first and second plane, step 550 is executed in which these signals are used to receive or transmit information to or from a space vehicle. Preferably, step 550 represents the normal communications system operations which the subscriber conducts with a moving communications node. Thus, step 550 can include transmitting electronic messaging information to the moving communications node, or receiving similar information from the moving communications node.

At step 560, a determination is made as to whether the target moving communications node has significantly moved from its previous location. In the event that the communications node has not moved significantly, step 550 continues to be executed. However, in the event that the target moving communications node has moved significantly, step 570 is executed in which the focus direction corresponding to a first plane is modified using a digital beamforming network in response to the movement of the target moving communications node. Step 580 follows in which the focus direction corresponding to a second plane is modified by way of mechanical steering in response to the movement of the target moving communications node. The method then returns to step 550 where bi-directional communications with the target moving communications node is continued.

Figure 5:
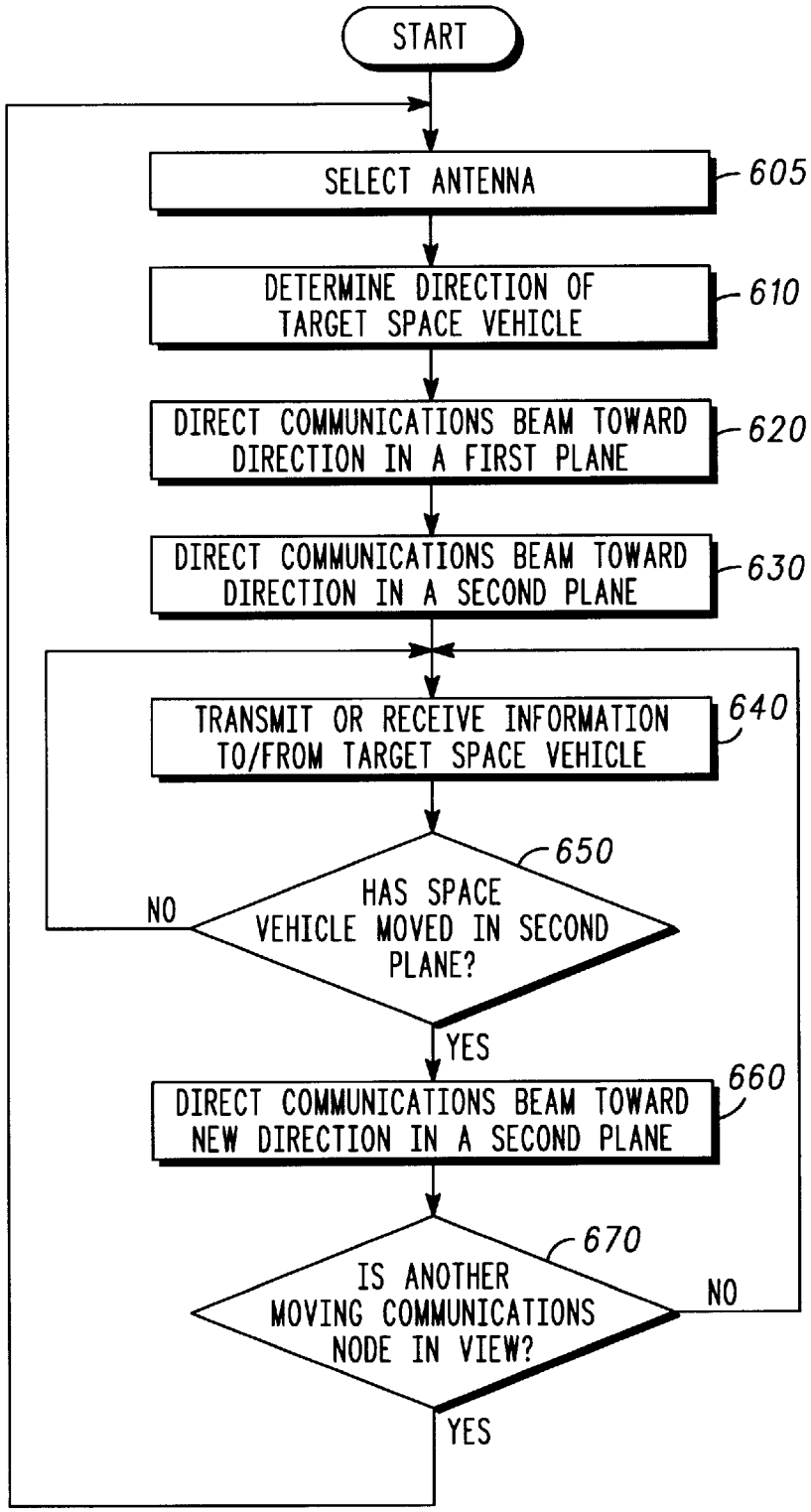
FIG. 5 is a flow chart of a second method executed by a mechanical scanning and digital beamforming antenna in accordance with a preferred embodiment of the invention.

FIG. 5 is a flow chart of a second method executed by a mechanical scanning and digital beamforming antenna in accordance with a preferred embodiment of the invention. The method of FIG. 5 describes the method executed by an apparatus similar to that of FIGS. 2 and 3 when the mechanical axis of the apparatus is aligned to be orthogonal to the trajectory of the moving communications node. Under these conditions, a digital beamforming network operating through a linear array can be used to perform the bulk of the tracking of the satellite communications node. This technique is highly desirable since wear on mechanical parts is significantly reduced since no mechanical steering is required to track the moving communications node in the trajectory.

The method of FIG. 5 begins with step 605 in which an antenna is selected for use in acquiring and tracking a target moving communications node. In a preferred embodiment, one of at least two antennas is selected for use. The method continues with step 610 where the direction of the target moving communications node is determined. In step 620, a communications beam is pointed toward a location in a first plane (such as the Y-Z plane of FIG. 2) preferably through mechanical means. In step 630, the communications beam is pointed toward the direction in a second plane (such as the X-Z plane of FIG. 2) preferably by way of electronic scanning. In step 640, the communications beam is used to receive or transmit information to and from the target moving communications node.

The method continues in step 650, where a decision is made as to whether the moving communications node has significantly moved in the second (X-Z) plane. If the decision of step 650 indicates that the target space vehicle has not moved significantly in the second (X-Z) plane, the method returns to step 640. In the event that the moving communications node has moved significantly in the second (X-Z) plane, the communications beam is redirected toward the new location. Preferably, step 660 is performed using only the electronic scanning function of the antenna and does not require participation of the mechanical portion of the antenna in order to direct the communications beam toward the new location.

The method continues in step 670 where a determination is made as to whether a second moving communications node is currently in view. In the event that a second space vehicle is not in view, the method returns to step 640. If however, the result of step 670 indicates that a second moving communications node is currently in view, step 605 is executed in which an antenna is selected for use.

Preferably, step 605 results in the selection of an antenna for use that is not currently being used to receive or transmit communications to or from a target moving communications node. Thus, when an idle antenna is selected, steps 610 through 670 are desirably executed using a different antenna than that previously used. Therefore, the method of FIG. 5 can be executed recursively and provide continuous communications services with successive moving communications nodes as these nodes enter into and exit from the view of the antenna.

A combined mechanical scanning and digital beamforming antenna provides the capability for subscribers make use of satellite communications services without exclusive reliance on mechanical tracking techniques. Since the contemplated invention is capable of generating two independent receive or transmit communications beam, the antenna is capable of establishing communications with a second moving communications node before suspending communications with a first moving communications node. Thus, the antenna provides reliable and uninterrupted service to consumers. In an alternate embodiment, the antenna can be oriented in order to generate communications beams directed toward terrestrial communications nodes and make use of a digital beamforming to generate multiple communications beams.

Accordingly, it is intended by the appended claims to cover all modifications of the invention that fall within the true spirit and scope of the invention.

What is claimed is:

1. In a subscriber unit, a method for acquiring and focusing a communications beam toward a target moving communications node, comprising:

determining a direction of a target moving communications node, said direction being expressed as a location in first and second planes;

directing said communications beam toward said direction in said first plane using a digital beamforming network;

directing said communications beam toward said direction in said second plane using a reflective surface; and directing, in said second plane, a second communications beam toward a direction corresponding to a second target moving communications node using a second reflective surface.

2. The method of claim 1, additionally comprising the step of transmitting information to said target moving communications node.

3. The method of claim 1, additionally comprising the step of receiving information from said target moving communications node.

4. The method of claim 1, additionally comprising the step of adjusting said digital beamforming network in a direction of said second plane in order to compensate for movement of said target moving communications node.

5. The method of claim 4, further comprising the step of directing, in said first plane, said second communications beam toward said direction corresponding to said second target moving communications node using a second digital beamforming network.

* * * * *